US009558871B2

(12) United States Patent
Takadate et al.

(10) Patent No.: US 9,558,871 B2
(45) Date of Patent: Jan. 31, 2017

(54) FE-BASED AMORPHOUS ALLOY AND DUST CORE MADE USING FE-BASED AMORPHOUS ALLOY POWDER

(71) Applicant: ALPS ELECTRIC CO., LTD., Tokyo (JP)

(72) Inventors: Kinshiro Takadate, Niigata-ken (JP); Hisato Koshiba, Niigata-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 392 days.

(21) Appl. No.: 14/134,809

(22) Filed: Dec. 19, 2013

(65) Prior Publication Data

US 2014/0102595 A1 Apr. 17, 2014

Related U.S. Application Data

(63) Continuation of application No. PCT/JP2012/068975, filed on Jul. 26, 2012.

(30) Foreign Application Priority Data

Jul. 28, 2011 (JP) ..... 2011-165020
Jul. 5, 2012 (JP) ..... 2012-151424

(51) Int. Cl.
*H01F 1/153* (2006.01)
*H01F 1/147* (2006.01)
(Continued)

(52) U.S. Cl.
CPC ..... *H01F 1/28* (2013.01); *B22F 9/002* (2013.01); *C22C 33/003* (2013.01);
(Continued)

(58) Field of Classification Search
CPC ..... C22C 45/02; C22C 45/00; C22C 38/02; C22C 38/32
See application file for complete search history.

(56) References Cited

U.S. PATENT DOCUMENTS 7,132,019 B2 11/2006 Koshiba et al.
8,685,179 B2 * 4/2014 Tsuchiya ..... C21D 6/00 148/304
(Continued)

FOREIGN PATENT DOCUMENTS

CN 101935812 A * 1/2011
JP 63-117406 5/1988
(Continued)

OTHER PUBLICATIONS

Machine translation of CN101935812 A, Jan. 2011.*
Search Report dated Oct. 30, 2012 from International Application No. PCT/JP2012/068975.

*Primary Examiner* — Jie Yang
*Assistant Examiner* — Xiaowei Su
(74) *Attorney, Agent, or Firm* — Beyer Law Group LLP

(57) ABSTRACT

An Fe-based amorphous alloy of the present invention has a composition represented by formula ($Fe_{100-a-b-c-d-e}Cr_aP_bC_cB_dSi_e$ (a, b, c, d, and e are in terms of at %), where 0 at %≤a≤1.9 at %, 1.7 at %≤b≤8.0 at %, 0 at %≤e≤1.0 at %, an Fe content (100-a-b-c-d-e) is 77 at % or more, 19 at %≤b+c+d+e≤21.1 at %, 0.08≤b/(b+c+d)≤0.43, 0.06≤c/(c+d)≤0.87, and the Fe-based amorphous alloy has a glass transition temperature (Tg).

12 Claims, 8 Drawing Sheets

(51) Int. Cl.

| | |
|---|---|
| ***C22C 45/02*** | (2006.01) |
| ***H01F 1/28*** | (2006.01) |
| ***B22F 9/00*** | (2006.01) |
| ***C22C 33/00*** | (2006.01) |
| ***C22C 33/02*** | (2006.01) |
| ***H01F 41/02*** | (2006.01) |

(52) U.S. Cl.
CPC ..... *C22C 33/0214* (2013.01); *C22C 33/0228* (2013.01); *C22C 45/02* (2013.01); *H01F 1/15308* (2013.01); *H01F 1/15375* (2013.01); *H01F 41/0246* (2013.01)

(56) References Cited

U.S. PATENT DOCUMENTS

| | | | | |
|---|---|---|---|---|
| 8,854,173 | B2 * | 10/2014 | Tsuchiya | B22F 1/0003 148/300 |
| 2008/0078474 | A1 * | 4/2008 | Naito | C22C 33/0207 148/304 |
| 2012/0092111 | A1 | 4/2012 | Tsuchiya et al. | |

FOREIGN PATENT DOCUMENTS

| | | | | |
|---|---|---|---|---|
| JP | 7-93204 | B2 | 10/1995 | |
| JP | 2009-299108 | | 12/2009 | |
| JP | 2010-10668 | | 1/2010 | |
| JP | WO 2011016275 | A1 * | 2/2011 | C21D 6/00 |

* cited by examiner

FE-BASED AMORPHOUS ALLOY AND DUST CORE MADE USING FE-BASED AMORPHOUS ALLOY POWDER

CLAIM OF PRIORITY

This application is a Continuation of International Application No. PCT/JP2012/068975 filed on Jul. 26, 2012, which claims benefit of Japanese Patent Application No. 2011-165020 filed on Jul. 28, 2011 and No. 2012-151424 filed on Jul. 5, 2012. The entire contents of each application noted above are hereby incorporated by reference.

BACKGROUND OF THE INVENTION

1. Field of the Invention

The present invention relates to an Fe-based amorphous alloy applied to, for example, dust cores of transformers and choke coils for power supplies.

2. Description of the Related Art

Dust cores used in booster circuits of hybrid vehicles and the like, and reactors, transformers, and choke coils used in power generation and transformer stations are produced by powder compaction of Fe-based amorphous alloy powder and binders. A metallic glass having good soft magnetic properties can be used as the Fe-based amorphous alloy.

However, in the related art, there were no Fe—Cr—P—C—B—Si-system Fe-based amorphous capable of exhibiting a high saturation magnetic flux density Bs (in particular, about 1.5 T or higher) while exhibiting a glass transition temperature (Tg).

US2012/0092111, U.S. Pat. No. 7,132,019, Japanese Examined Patent Application Publication No. 7-93204, and Japanese Unexamined Patent Application Publication No. 2010-10668 disclose compositions of Fe—Cr—P—C—B—Si-based soft magnetic alloys but do not disclose an Fe—Cr—P—C—B—Si-based soft magnetic alloy capable of exhibiting a high saturation magnetic flux density Bs of about 1.5 T or higher while exhibiting a glass transition temperature (Tg).

SUMMARY OF THE INVENTION

The present invention provides an Fe-based amorphous alloy capable of exhibiting a high saturation magnetic flux density Bs while exhibiting a glass transition temperature (Tg), and a dust core made using an Fe-based amorphous alloy powder.

An aspect of the present invention provides an Fe-based amorphous alloy having a composition represented by formula ($Fe_{100-a-b-c-d-e}Cr_aP_bC_cB_dSi_e$ (a, b, c, d, and e are in terms of at %)), where 0 at %≤a≤1.9 at %, 1.7 at %≤b≤8.0 at %, 0 at %≤e≤1.0 at %, and an Fe content (100-a-b-c-d-e) is 77 at % or more, 19 at %≤b+c+d+e≤21.1 at %, 0.08≤b/(b+c+d)≤0.43, 0.06≤c/(c+d)≤0.87, and the Fe-based amorphous alloy has a glass transition point (Tg).

Preferably, 0.75 at %≤c≤13.7 at % and 3.2 at %≤d≤12.2 at %. As a result, the glass transition temperature (Tg) can reliably emerge.

The B content d is preferably 10.7 at % or less. The P content b is preferably 7.7 at % or less. Preferably, b/(b+c+d) is 0.16 or more. Preferably, c/(c+d) is 0.81 or less. As a result, an amorphous structure can be formed, a saturation magnetic flux density Bs of 1.5 T or higher can be reliably achieved, and a glass transition temperature (Tg) can stably emerge.

Preferably, 0 at %≤e≤0.5 at %. As a result, the Tg can be decreased.

Preferably, 0.08≤b/(b+c+d)≤0.32 and 0.06≤c/(c+d)≤0.73.

Preferably, 4.7 at %≤b≤6.2 at %. Preferably, 5.2 at %≤c≤8.2 at % and 6.2 at %≤d≤10.7 at %. The B content d is more preferably 9.2 at % or less. Preferably, 0.23≤b/(b+c+d)≤0.30 and 0.32≤c/(c+d)≤0.87. Here, the Fe-based amorphous alloy is preferably produced by a water atomization method. As a result, the alloy can be appropriately made amorphous (amorphization) and a glass transition temperature (Tg) can reliably emerge. Typically, an Fe-based amorphous alloy produced by a water atomization method can only exhibit a saturation magnetic flux density Bs of 1.4 T or lower. According to the present invention, the saturation magnetic flux density Bs of the Fe-based amorphous alloy produced by a water atomization method can be increased to about 1.5 T or higher. The water atomization method is a simple process for obtaining a uniform and substantially spherical magnetic alloy powder and the magnetic alloy powder obtained by this method can be mixed with a binder such as a binder resin and processed into dust cores having various shapes through press forming techniques. In the present invention, a dust core having a high saturation magnetic flux density can be obtained by adjusting the alloy composition as described above.

A saturation magnetic flux density Bs of 1.5 T or higher can be stably obtained when 4.7 at %≤b≤6.2 at %, 5.2 at %≤c≤8.2 at %, 6.2 at %≤d≤9.2 at %, 0.23≤b/(b+c+d)≤0.30, and 0.36≤c/(c+d)≤0.57.

DESCRIPTION OF THE PREFERRED EMBODIMENTS

Figure 1:
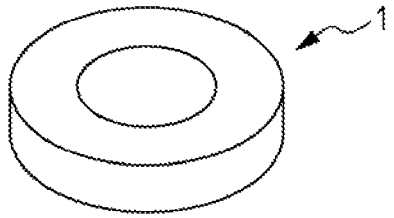
FIG. 1 is a perspective view of a dust core.

An Fe-based amorphous alloy according to this embodiment has a composition represented by formula ($Fe_{100-a-b-c-d-e}Cr_aP_bC_cB_dSi_e$ (a, b, c, d, and e are in terms of at %)), where 0 at %≤a≤1.9 at %, 1.7 at %≤b≤8.0 at %, and 0 at %≤e≤1.0 at %. The Fe content (100-a-b-c-d-e) is 77 at % or more, 19 at %≤b+c+d+e≤21.1 at %, 0.08≤b/(b+c+d)≤0.43, and 0.06≤c/(c+d)≤0.87.

As described above, the Fe-based amorphous alloy according to this embodiment is a metallic glass containing Fe as a main component and Cr, P, C, B, and Si added at the above-described compositional ratio.

The Fe-based amorphous alloy according to this embodiment is amorphous, has a glass transition temperature (Tg), and achieves a high saturation magnetic flux density Bs. Moreover, a structure having high corrosion resistance can be obtained.

In the description below, the contents of the respective constitutional elements in Fe—Cr—P—C—B—Si are first described.

The Fe content in the Fe-based amorphous alloy of this embodiment is the remainder when the Cr, P, C, B, and Si contents are subtracted from Fe—Cr—P—C—B—Si. In the compositional formula described above, the Fe content is expressed as (100-a-b-c-d-e). The Fe content is preferably high in order to obtain a high Bs and is to be 77 at % or more. However, if the Fe content is excessively high, the Cr, P, C, B, and Si contents become excessively low and emergence of the glass transition temperature (Tg) and formation of an amorphous structure may be adversely affected. Thus the Fe content is preferably 81 at % or lower and more preferably 80 at % or lower.

The Cr content a in Fe—Cr—P—C—B—Si is specified to be within the range of 0 at %≤a≤1.9 at %. Chromium (Cr) accelerates formation of a passive layer on particle surfaces and improves corrosion resistance of the Fe-based amorphous alloy. For example, in forming Fe-based amorphous alloy powder through a water atomization method, occurrence of corroded parts at the time the molten alloy directly comes into contact with water or in the step of drying the Fe-based amorphous alloy powder after the water atomization can be prevented. Meanwhile, addition of Cr decreases the saturation magnetic flux density Bs and tends to increase the glass transition temperature (Tg). Accordingly, it is effective to suppress the Cr content a to a minimum level. A Cr content a is preferably set to be within the range of 0 at %≤a≤1.9 at % since then a saturation magnetic flux density Bs of about 1.5 T or higher can be reliably obtained.

Moreover, the Cr content a is preferably set to be 1 at % or lower. Thus, a saturation magnetic flux density Bs as high as 1.55 T or higher and 1.6 T or higher can be reliably obtained in some cases while the glass transition temperature (Tg) is maintained at a low temperature.

The P content b in Fe—Cr—P—C—B—Si is specified to be within the range of 1.7 at %≤b≤8.0 at %. Thus, a high saturation magnetic flux density Bs of about 1.5 T or higher can be achieved. Moreover, the glass transition temperature (Tg) easily emerges. According to the related art, as shown by the patent literatures etc., the P content has been set relatively high, such as at about 10 at %; however, in this embodiment, the P content b is set lower than in the related art. Phosphorus (P) is a semimetal related to formation of an amorphous structure. However, as described below, a high Bs can be achieved and formation of an amorphous structure can be appropriately accelerated by adjusting the total content of P and other semimetals.

In order to obtain a higher saturation magnetic flux density Bs, the P content b is set to be within the range of 7.7 at % or less and preferably 6.2 at % or less. The lower limit of the P content b is preferably changed according to the production method as described below. For example, in order to produce an Fe-based amorphous alloy by a water atomization method, the P content b is preferably set to 4.7 at % or more. Crystallization easily occurs at a P content b less than 4.7 at %. In contrast, in order to produce an Fe-based amorphous alloy by a melt spinning method, the lower limit can be set at 1.7 at % or about 2 at %. If the emphasis is on the ease of forming an amorphous structure while causing a glass transition temperature (Tg) to emerge reliably, the lower limit of the P content b is set at about 3.2 at %. In the melt spinning method, the upper limit of the P content b is set to 4.7 at % and is preferably about 4.0 at % so as to achieve a high saturation magnetic flux density Bs.

The Si content e in Fe—Cr—P—C—B—Si is specified to be within the range of 0 at %≤e≤1.0 at %. Addition of Si is considered to contribute to improving the ability of forming an amorphous structure. However, as the Si content e is increased, the glass transition temperature (Tg) tends to increase or vanish, thereby inhibiting formation of an amorphous structure. Accordingly, the Si content e is 1.0 at % or less and preferably 0.5 at % or less.

In this embodiment, the total content (b+c+d+e) of semimetal elements P, C, B, and Si is specified to be in the range of 19 at % or more and 21.1 at % or less. Because the P and Si contents b and e are within the above-described ranges, the range of the total content (c+d) of elements C and B is determined. Furthermore, as described below, because the range of c/(c+d) is specified as below, neither the C content nor the B content is 0 at % and there are particular compositional ranges for these elements.

When the total content (b+c+d+e) of the semimetals P, C, B, and Si is 19 at % to 21.1 at %, a high saturation magnetic flux density Bs of about 1.5 T or higher can be obtained while an amorphous structure can be formed.

In this embodiment, the compositional ratio of P in P, C, and B, [b/(b+c+d)], is specified to be within the range of 0.08 or more and 0.43 or less. Thus, a glass transition temperature (Tg) can emerge and a high saturation magnetic flux density Bs of about 1.5 T or higher can be achieved.

In this embodiment, the compositional ratio of C in C and B, [c/(c+d)], is specified to be within the range of 0.06 or more and 0.87 or less. In this manner, the Bs can be increased and the ability to form an amorphous structure can be enhanced. Moreover, a glass transition temperature (Tg) emerges appropriately.

In sum, the Fe-based amorphous alloy of this embodiment exhibits a glass transition temperature (Tg) and a high saturation magnetic flux density Bs, in particular, a Bs of about 1.5 T or higher.

The Fe-based amorphous alloy of this embodiment can be produced in a ribbon shape by a melt spinning method. During this process, the limit thickness of the amorphous alloy is as large as about 150 to 180 μm. For example, for FeSiB-based amorphous alloys, the limit thickness is about 70 to 100 μm. Thus, according to this embodiment, the thickness can be about twice the thickness of the FeSiB-based amorphous alloys or more.

The ribbon is pulverized into a powder and used in manufacturing the dust cores and the like. Alternatively, an Fe-based amorphous alloy powder can be produced by a water atomization method or the like.

It is easier to achieve a high Bs by producing a ribbon-shaped Fe-based amorphous alloy through a melt spinning method than by producing the alloy through a water atomization method. However, even if an Fe-based amorphous alloy powder is obtained by a water atomization method, it is possible to achieve a high saturation magnetic flux density Bs of about 1.5 T or higher as shown by the experimental results below.

A preferable composition for producing an Fe-based amorphous alloy by a melt spinning method will now be described.

In this embodiment, the C content c is preferably set to be 0.75 at % or more and 13.7 at % or less and the B content d is preferably set to be 3.2 at % or more and 12.2 at % or less. Carbon (C) and boron (B) are both a semimetal and addition of C and B can enhance the ability to form an amorphous structure; however, if the contents of these elements are excessively small or large, the glass transition temperature (Tg) may vanish or even if a glass transition temperature (Tg) emerges, the composition adjusting ranges for other elements become very narrow. Accordingly, for stable emergence of a glass transition temperature (Tg), the C and B contents are preferably within the compositional ranges described above. The C content c is more preferably 12.0 at % or less. The B content d is more preferably 10.7 at % or less.

The compositional ratio of P in P, C, and B, [b/(b+c+d)], is preferably 0.16 or more. The compositional ratio of C in C and B, [c/(c+d)], is more preferably 0.81 or less. In this manner, the Bs can be increased and the ability to form an amorphous structure can be enhanced. Moreover, a glass transition temperature (Tg) can reliably emerge.

In this embodiment, it is possible to increase the saturation magnetic flux density Bs of the Fe-based amorphous alloy produced by a melt spinning method to 1.5 T or higher. It becomes possible to obtain a saturation magnetic flux density Bs of 1.6 T or higher by adjusting the compositional ratio of P in P, C, and B, [b/(b+c+d)], to 0.08 or more and 0.32 or less and the compositional ratio of C in C and B, [c/(c+d)], to 0.06 or more and 0.73 or less. More preferably, c/(c+d) is 0.19 or more.

Next, a preferable composition for producing an Fe-based amorphous alloy by a water atomization method is described.

The P content b is preferably 4.7 at %≤b≤6.2 at %. In this manner, amorphization can stably occur and a high saturation magnetic flux density Bs of about 1.5 T or higher can be obtained. The phrase "about 1.5 T or higher" means that the saturation magnetic flux density Bs may be a value slightly lower than 1.5 T and more specifically may be about 1.45 T which can be rounded to 1.5 T. In particular, it has been difficult for an Fe-based amorphous alloy produced by a water atomization method to achieve a saturation magnetic flux density Bs of 1.4 T or higher. However, according to this embodiment, a saturation magnetic flux density Bs of about 1.5 T or higher, which is significantly higher than that achieved by the related art, can be stably achieved.

The C content c is preferably 5.2 at % or more and 8.2 at % or less and the B content d is preferably 6.2 at % or more and 10.7 at % or less. The B content d is more preferably 9.2 at % or less. Carbon (C) and boron (B) are both a semimetal and addition of these elements can enhance the ability to form an amorphous structure; however, if the contents of these elements are excessively small or large, the glass transition temperature (Tg) may vanish or even if a glass transition temperature (Tg) emerges, the composition adjusting ranges for other elements become very narrow. As shown by the experimental results below, adjusting the contents as described above makes it possible to achieve amorphization and stably obtain a saturation magnetic flux density Bs of about 1.5 T or higher.

Preferably, 0.23≤b/(b+c+d)≤0.30 and 0.32≤c/(c+d)≤0.87. As shown by the experimental results below, it becomes possible to achieve amorphization and stably obtain a saturation magnetic flux density Bs of about 1.5 T or higher.

For the Fe-based amorphous alloy produced by a water atomization method, more preferably, 4.7 at %≤b≤6.2 at %, 5.2 at %≤c≤8.2 at %, 6.2 at %≤d≤9.2 at %, 0.23≤b/(b+c+d)≤0.30, and 0.36≤c/(c+d)≤0.57. Thus, a high saturation magnetic flux density Bs of 1.5 T or higher can be stably obtained.

As shown by the experiments described below, the Fe-based amorphous alloy produced by a water atomization method tends to show a lower saturation magnetic flux density Bs than the Fe-based amorphous alloy produced by a melt spinning method. This is presumably due to contamination in raw materials used and the influence of powder oxidation during atomization, for example.

In the case where an Fe-based amorphous alloy is produced by a water atomization method, the compositional range for forming an amorphous structure tends to be narrow compared to the melt spinning method. However, the experiments described below show that even the Fe-based amorphous alloy produced by the water atomization method can exhibit a high saturation magnetic flux density Bs of about 1.5 T or higher while being amorphous as with those produced by a melt spinning method.

In particular, Fe-based amorphous alloys produced by typical water atomization methods have had a low saturation magnetic flux density Bs of 1.4 T or lower; however, according to this embodiment, it becomes possible for the alloys to achieve a saturation magnetic flux density Bs of about 1.5 T or higher.

The composition of the Fe-based amorphous alloy of this embodiment can be analyzed with ICP-MS (inductively coupled plasma mass spectrometer) or the like.

Figure 2:
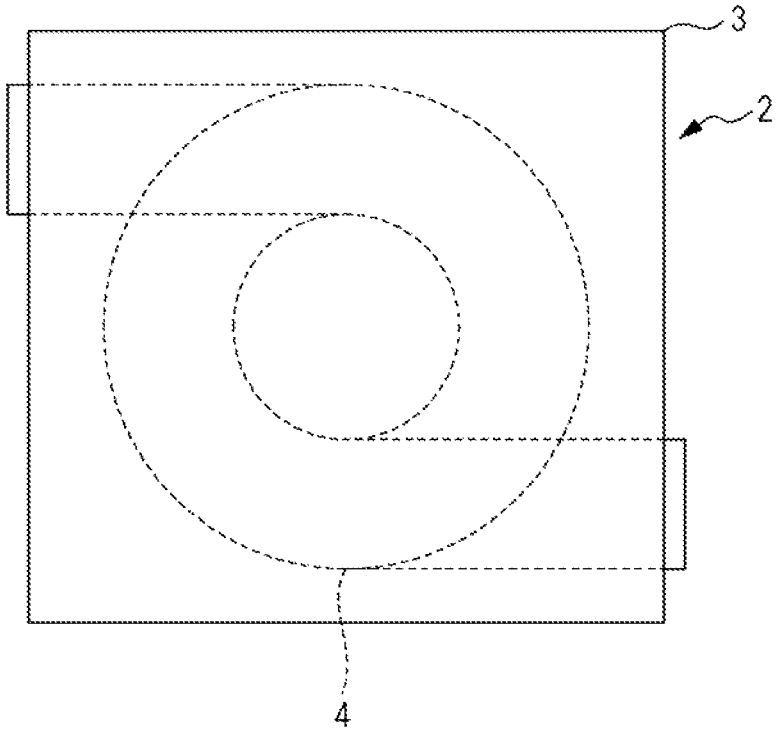
FIG. 2 is a plan view of a coil-sealed dust core.

In this embodiment, a powder of the Fe-based amorphous alloy represented by the compositional formula above is mixed with a binder and solidified so as to form a ring-shaped dust core 1 shown in FIG. 1 or a coil-sealed dust core 2 shown in FIG. 2. The coil-sealed dust core 2 shown in FIG. 2 is constituted by a dust core 3 and a coil 4 covering the dust core 3. There are numerous particles of the Fe-based amorphous alloy powder in the core and the Fe-based amorphous alloy particles are insulated from one another by the binder.

Examples of the binder include liquid or powdery resin and rubber such as epoxy resin, silicone resin, silicone rubber, phenolic resin, urea resin, melamine resin, PVA (polyvinyl alcohol), and acrylic acid, liquid glass ($Na_2O$—$SiO_2$), oxide glass powder ($Na_2O$—$B_2O_3$—$SiO_2$, PbO—$B_2O_3$—$SiO_2$, PbO—BaO—$SiO_2$, $Na_2O$—$B_2O_3$—ZnO, CaO—BaO—$SiO_2$, $Al_2O_3$—$B_2O_3$—$SiO_2$, and $B_2O_3$—$SiO_2$), and glassy substances produced by sol-gel methods (those mainly composed of $SiO_2$, $Al_2O_3$, $ZrO_2$, $TiO_2$, and the like).

Zinc stearate, aluminum stearate, and the like can be used as a lubricant. The mixing ratio of the binder is 5 mass % or less and the lubricant content is about 0.1 mass % to 1 mass %.

After press-forming, the dust core is heat-treated to relax the stress strain on the Fe-based amorphous alloy powder. In this embodiment, the glass transition temperature (Tg) of the Fe-based amorphous alloy powder can be decreased and thus the optimum heat-treatment temperature of the core can be made lower than that typically required. The "optimum heat-treatment temperature" means a heat-treatment temperature for a core compact at which the stress strain on the Fe-based amorphous alloy powder can be effectively relaxed and the core loss can be minimized.

EXAMPLES

Experiments Related to Saturation Magnetic Flux Density Bs and Other Alloy Properties: Melt Spinning Method Fe-based amorphous alloys having compositions shown in Table 1 in Appendix were produced by a melt spinning method so as to have a ribbon shape. In particular, a ribbon was obtained in an Ar atmosphere at a reduced pressure by a single roll method involving ejecting a melt of Fe—Cr—P—C—B—Si from a crucible nozzle onto a rotating roll to conduct rapid cooling. The ribbon production conditions were set as follows. The distance (gap) between the nozzle and the roll surface was about 0.3 mm; the peripheral speed of the rotating roll was about 2000 m/min, and the ejection pressure was set to about 0.3 kgf/cm$^2$. The thickness of each ribbon obtained was about 20 to 25 μm.

All samples in Table 1 were confirmed to be amorphous with an XRD (X-ray diffraction analyzer). The Curie temperature (Tc), the glass transition temperature (Tg), the crystallization onset temperature (Tx), and the melting temperature (Tm) were measured with a DSC (differential scanning calorimeter) (heating rate was 0.67 K/sec for Tc, Tg, and Tx and 0.33 K/sec for Tm).

The saturation magnetic flux density Bs and the saturation mass magnetization σs in Table 1 were measured with a VSM (vibrating sample magnetometer) under application of a 10 kOe magnetic field. The density D shown in Table 1 was measured by the Archimedean method. The figures in the columns of Table 1 were rounded if they were indivisible. Thus, for example, "0.52" has a range of 0.515 to 0.524.

The graphs indicating dependency of the saturation magnetic flux density Bs, the saturation mass magnetization as, the Curie temperature (Tc), the glass transition temperature (Tg), the crystallization onset temperature (Tx), ΔTx, the melting temperature (Tm), the reduced glass transition temperature (Tg/Tm), and Tx/Tm in Table 1 on the composition are shown in FIGS. 3 to 11. ΔTx equals Tx−Tg.

It was found that the Fe-based amorphous alloys of Comparative Examples shown in Table 1 either have a lower saturation magnetic flux density Bs than in Examples or have no glass transition temperature (Tg) if they are capable of exhibiting a high saturation magnetic flux density Bs.

In contrast, the Fe-based amorphous alloys of Examples shown in Table 1 exhibited a glass transition temperature (Tg) and a high saturation magnetic flux density Bs of about 1.5 T or higher. In particular, Nos. 43 to 53, No. 57, No. 62, No. 65, No. 67, No. 77, No. 79, No. 81, and No. 82 samples were found to exhibit a saturation magnetic flux density Bs exceeding 1.6 T.

FIGS. 3 to 11 show the dependency on the composition for $Fe_{77.9}Cr_1P_{(20.8-c-d)}C_cB_dSi_{0.5}$. A relatively dark region in each diagram is a compositional region where no glass transition temperature (Tg) emerges.

Figure 3:
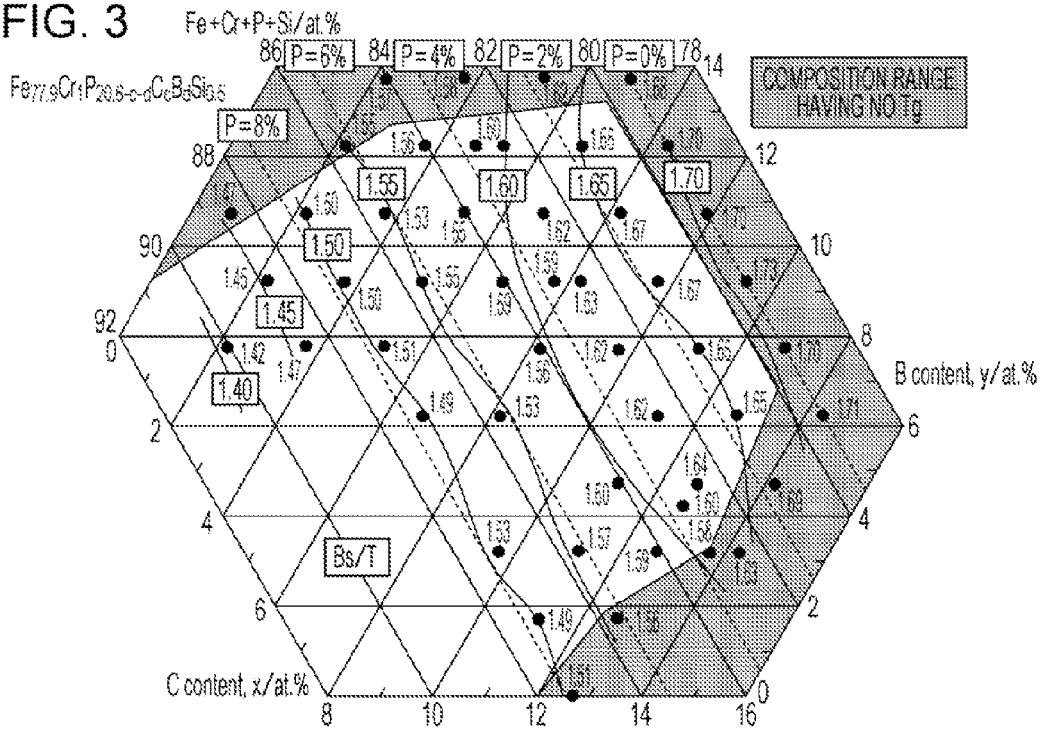
FIG. 3 is a graph showing the dependency of the saturation magnetic flux density Bs on the composition for $Fe_{77.9}Cr_1P_{(20.8-c-d)}C_cB_dSi_{0.5}$ produced by a melt spinning method.

FIG. 3 shows the dependency of the saturation magnetic flux density Bs on the composition for $Fe_{77.9}Cr_1P_{(20.8-c-d)}C_cB_dSi_{0.5}$. Lines indicating the P content b of 0 at %, 2 at %, 4 at %, 6 at %, and 8 at % were drawn on the diagram of FIG. 3. It was found that, as shown in FIG. 3, as the P content b is decreased, a higher saturation magnetic flux density Bs is obtained but a glass transition temperature (Tg) becomes more difficult to emerge.

Figure 4:
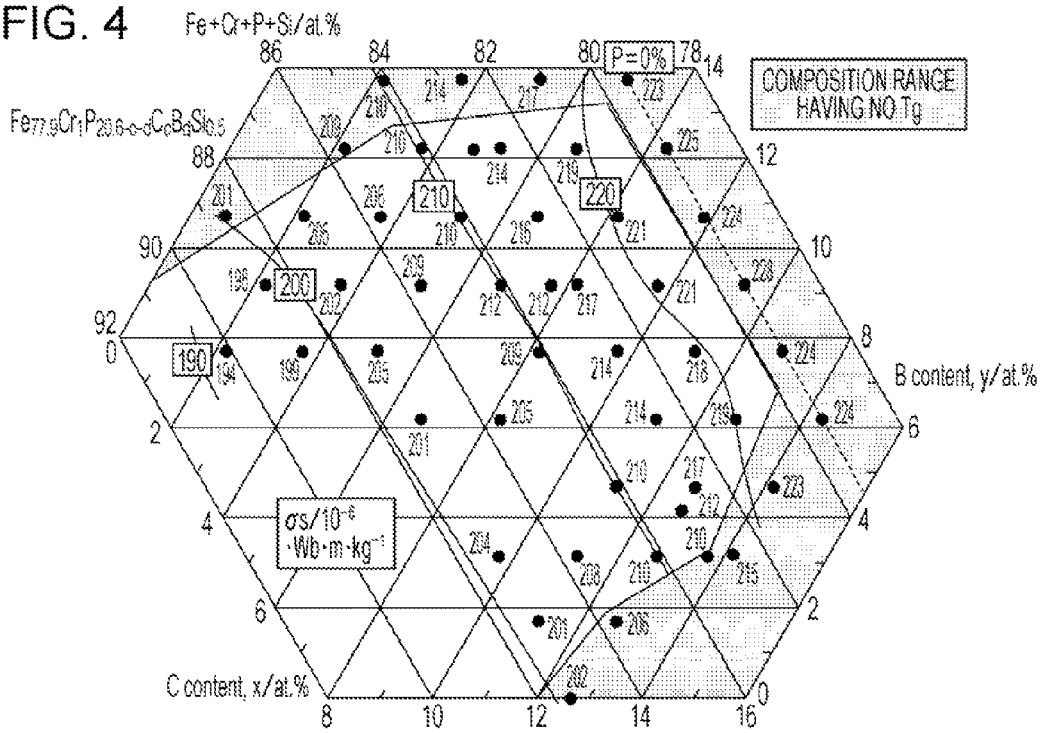
FIG. 4 is a graph showing the dependency of the saturation mass magnetization σs on the composition for $Fe_{77.9}Cr_1P_{(20.8-e-d)}C_cB_dSi_{0.5}$ produced by a melt spinning method.

FIG. 4 shows the dependency of the saturation mass magnetization css on the composition for $Fe_{77.9}Cr_1P_{(20.8-c-d)}C_cB_dSi_{0.5}$. FIG. 4 shows that in Examples, a saturation mass magnetization as of about 190 to about 230 ($10^{-6}$·wb·m·kg$^{-1}$) can be obtained.

Figure 5:
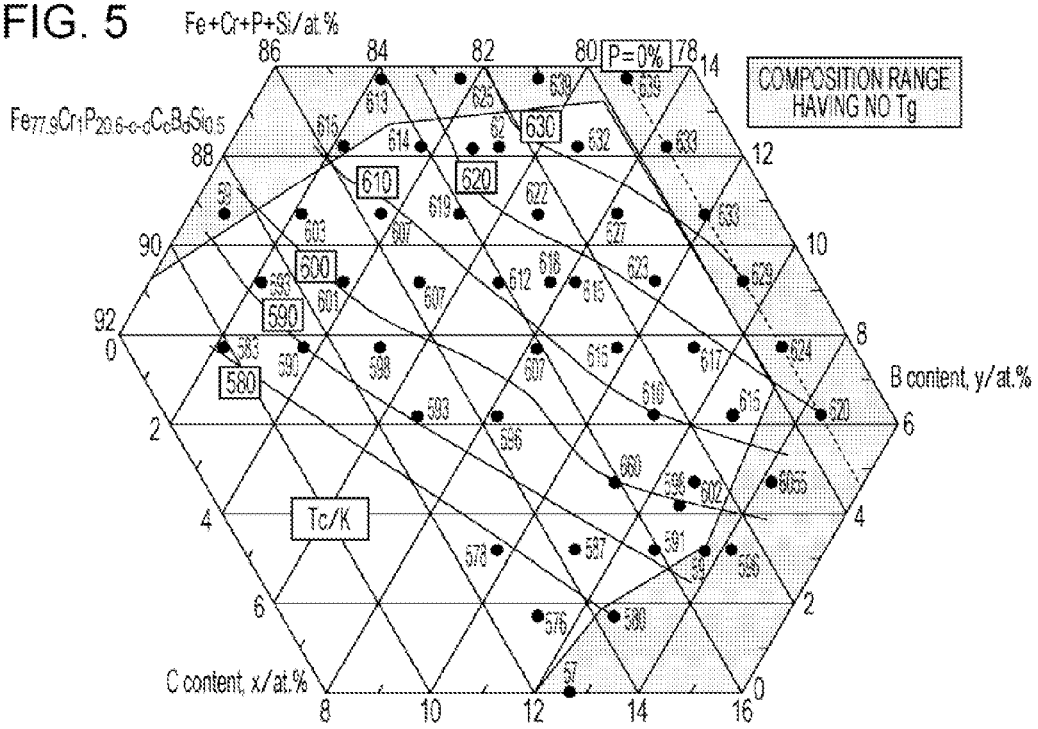
FIG. 5 is a graph showing the dependency of the Curie temperature (Tc) on the composition for $Fe_{77.9}Cr_1P_{(20.8-c-d)}C_cB_dSi_{0.5}$ produced by a melt spinning method.

FIG. 5 shows the dependency of the Curie temperature (Tc) on the composition for $Fe_{77.9}Cr_1P_{(20.8-c-d)}C_cB_dSi_{0.5}$. FIG. 5 shows that in Examples, a Curie temperature (Tc) of about 580 K to about 630 K is obtained and there is no problem from a practical perspective.

Figure 6:
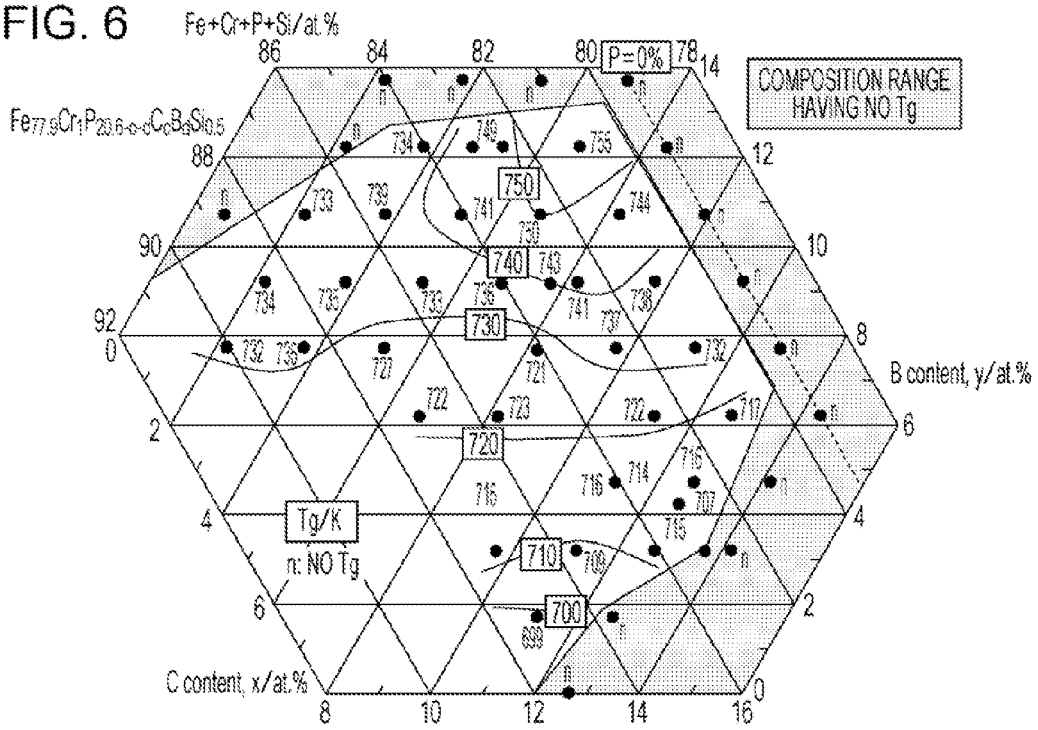
FIG. 6 is a graph showing the dependency of the glass transition temperature (Tg) on the composition for $Fe_{77.9}Cr_1P_{(20.8-c-d)}C_cB_dSi_{0.5}$ produced by a melt spinning method.

FIG. 6 shows the dependency of the glass transition temperature (Tg) on the composition for $Fe_{77.9}Cr_1P_{(20.8-c-d)}C_cB_dSi_{0.5}$. It was found that a glass transition temperature (Tg) of about 700 K to about 740 K can be obtained according to Examples.

Figure 7:
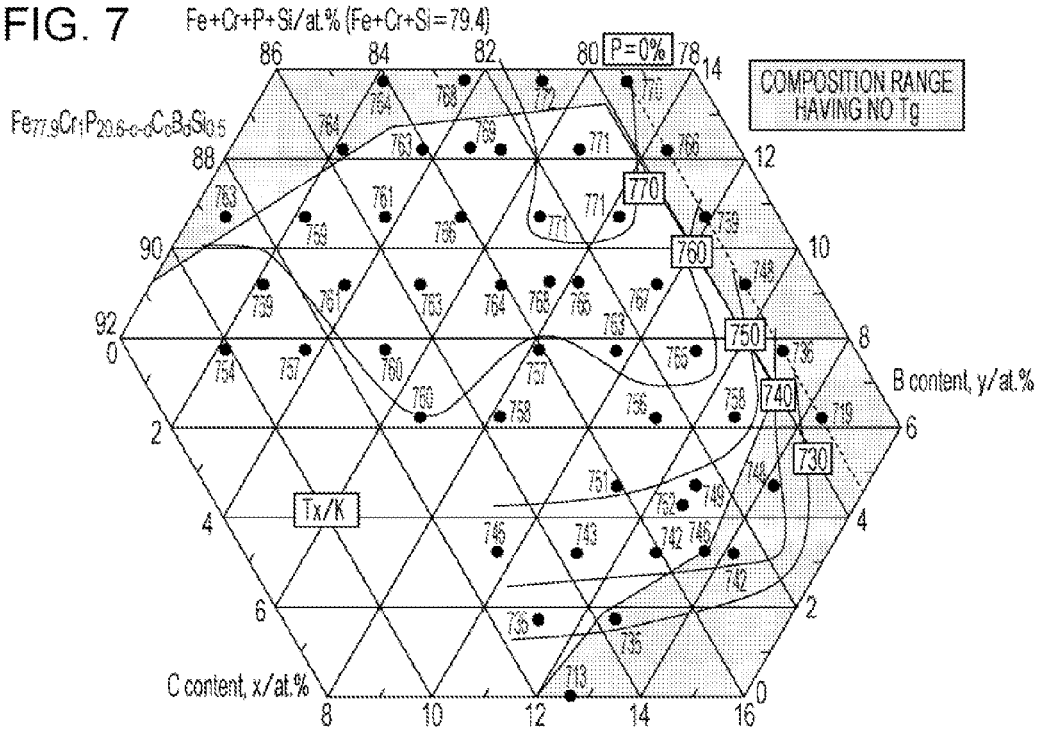
FIG. 7 is a graph showing the dependency of the crystallization onset temperature (Tx) on the composition for $Fe_{77.9}Cr_1P_{(20.8-c-d)}C_cB_dSi_{0.5}$ produced by a melt spinning method.

FIG. 7 is a graph indicating the dependency of the crystallization onset temperature (Tx) on the composition for $Fe_{77.9}Cr_1P_{(20.8-c-d)}C_cB_dSi_{0.5}$. It was found that a crystallization onset temperature (Tx) of about 740 K to about 770 K can be obtained in Examples.

Figure 8:
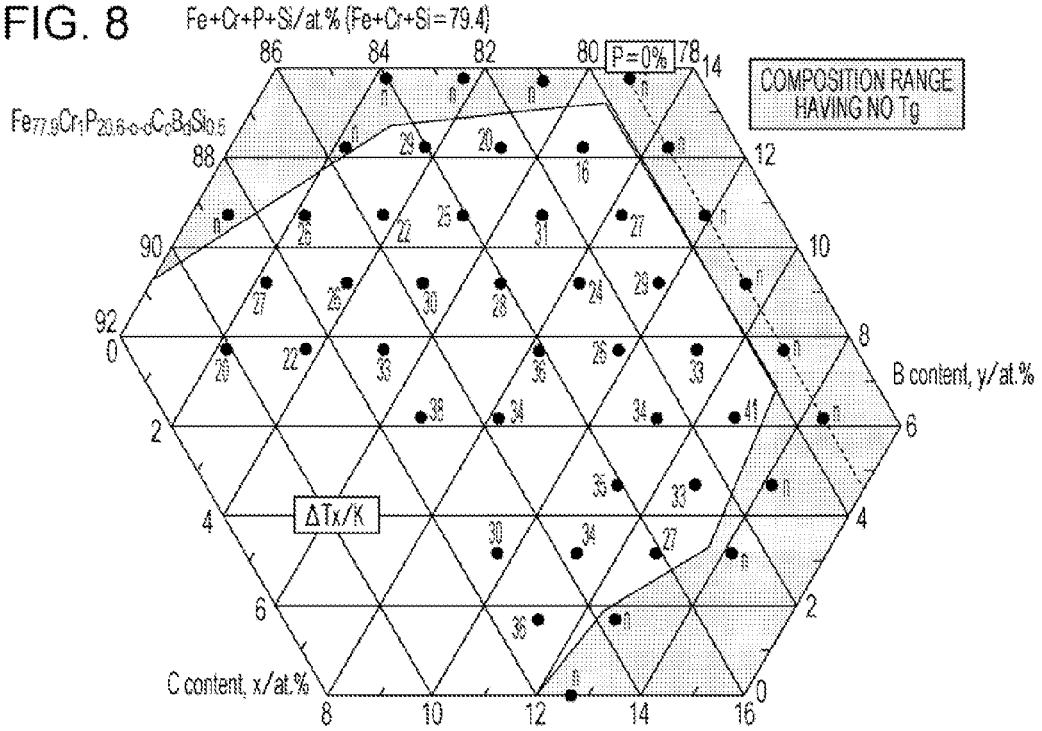
FIG. 8 is a graph showing the dependency of ΔTx on the composition for $Fe_{77.9}Cr_1P_{(20.8-c-d)}C_cB_dSi_{0.5}$ produced by a melt spinning method.

FIG. 8 is a graph indicating the dependency of ΔTx on the composition for $Fe_{77.9}Cr_1P_{(20.8-c-d)}C_cB_dSi_{0.5}$. It was found that a ΔTx of about 15 K to about 40 K is obtained in Examples.

In sum, it was found that Examples exhibited a high saturation magnetic flux density Bs and a high ability to form an amorphous structure attributable to the presence of a glass transition temperature (Tg) and ΔTx associated therewith. Accordingly, an Fe-based amorphous alloy having a high saturation magnetic flux density can be easily obtained even when the cooling conditions and the like are relaxed.

Figure 9:
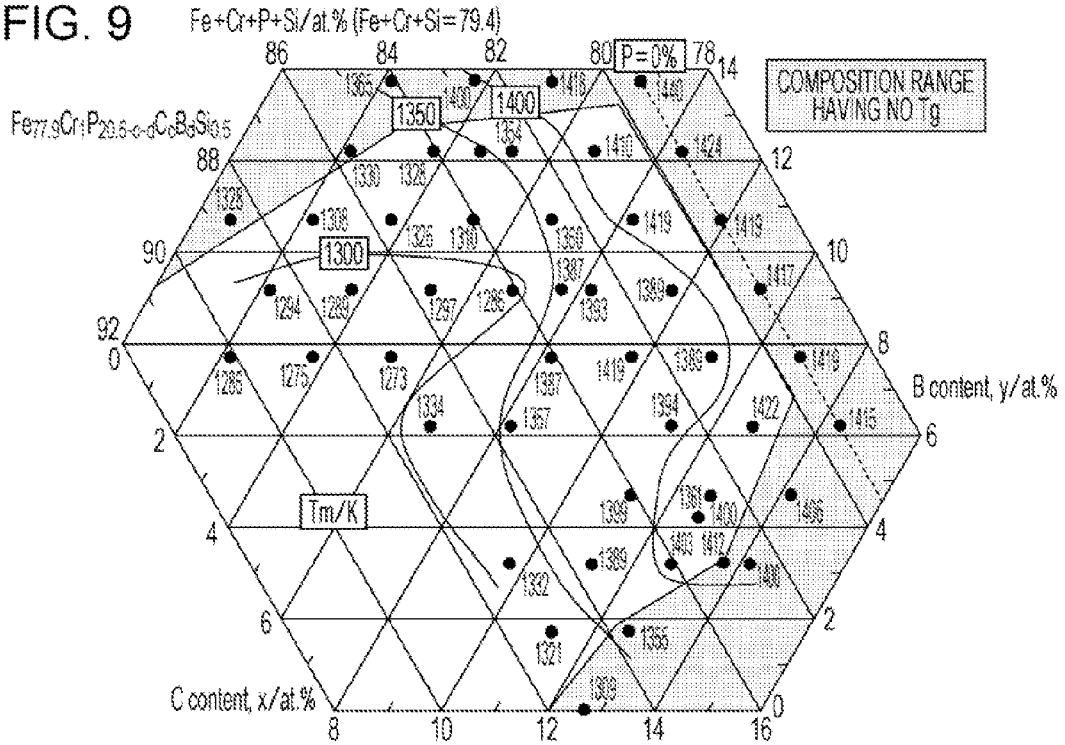
FIG. 9 is a graph showing the dependency of the melting temperature (Tm) on the composition for $Fe_{77.9}Cr_1P_{(20.8-c-d)}C_cB_dSi_{0.5}$ produced by a melt spinning method.

FIG. 9 is a graph showing the dependency of the melting temperature (Tm) on the composition for $Fe_{77.9}Cr_1P_{(20.8-c-d)}C_cB_dSi_{0.5}$. It was found that a melting point (Tm) of about 1300 K to about 1400 K can be achieved in Examples. This melting temperature (Tm) is lower than that of typical Fe—Si—B amorphous alloys that have no glass transition temperature (Tg). Because of this feature, Fe-based amorphous alloys of Examples are advantageous in terms of production compared to typical Fe—Si—B amorphous alloys.

Figure 10:
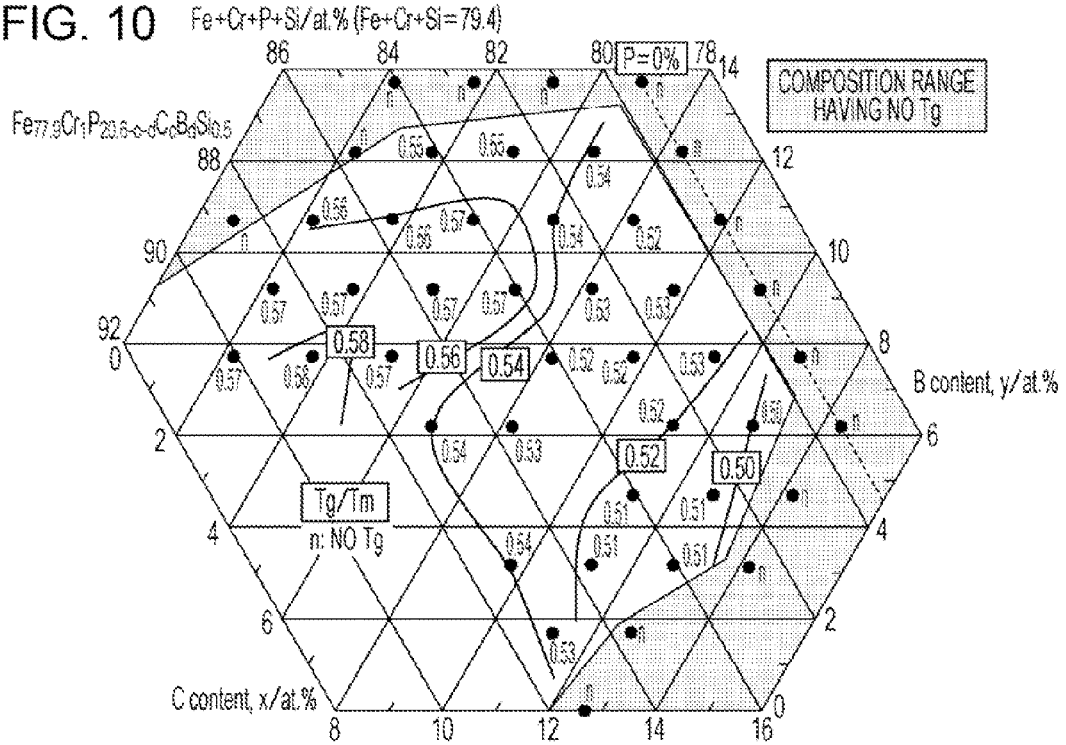
FIG. 10 is a graph showing the dependency of Tg/Tm on the composition for $Fe_{77.9}Cr_1P_{(20.8-c-d)}C_cB_dSi_{0.5}$ produced by a melt spinning method.
Figure 11:
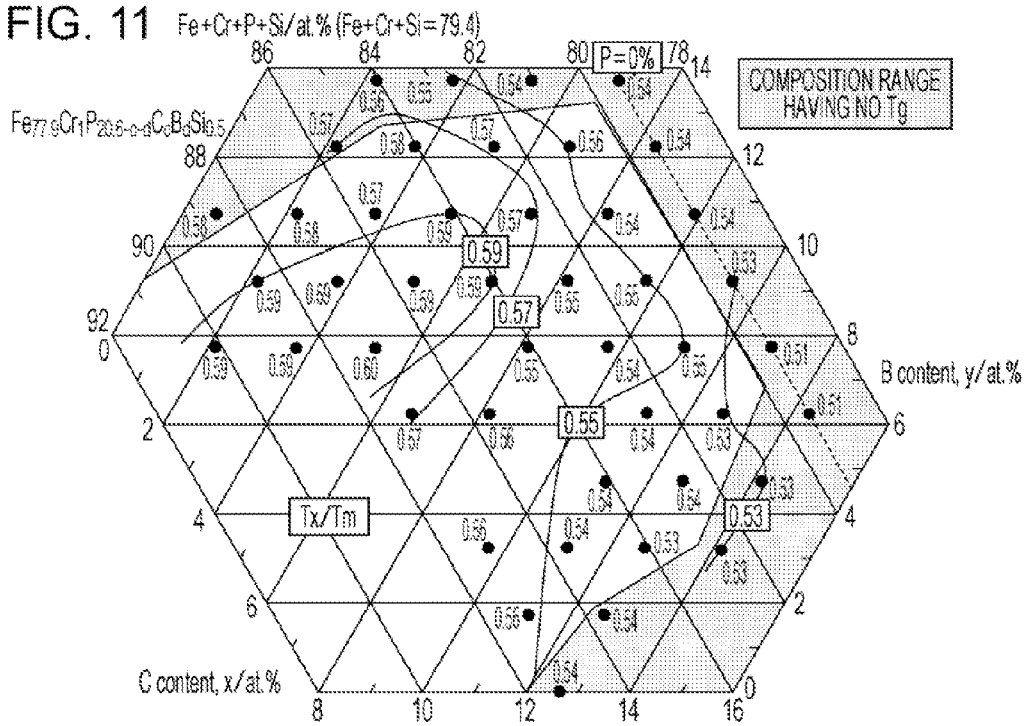
FIG. 11 is a graph showing the dependency of Tx/Tm on the composition for $Fe_{77.9}Cr_1P_{(20.8-c-d)}C_cB_dSi_{0.5}$ produced by a melt spinning method.

FIG. 10 is a graph showing the dependency of the reduced glass transition temperature (Tg/Tm) on the composition for $Fe_{77.9}Cr_1P_{(20.8-c-d)}C_cB_dSi_{0.5}$. FIG. 11 is a graph showing the dependency of Tx/Tm on the composition for $Fe_{77.9}Cr_1P_{(20.8-c-d)}C_cB_dSi_{0.5}$.

The reduced glass transition temperature (Tg/Tm) and Tx/Tm are preferably high in order to obtain a high ability to form an amorphous structure. It was found that a reduced glass transition temperature (Tg/Tm) of 0.50 or more and Tx/Tm of 0.53 or more can be achieved in Examples.

Experiments related to saturation magnetic flux density Bs and other alloy properties: water atomization method.

Fe-based amorphous alloys having compositions shown in Table 2 were produced by a water atomization method.

The melt temperature (temperature of the melted alloy) for obtaining powders was 1500° C. and the water ejection pressure was 80 MPa.

The mean particle size (D50) of the Fe-based amorphous alloy powders produced by the water atomization method was 10 to 12 μm. The mean particle size was measured with a Microtrac particle size distribution analyzer MT300EX produced by Nikkiso Co., Ltd.

Figure 12:
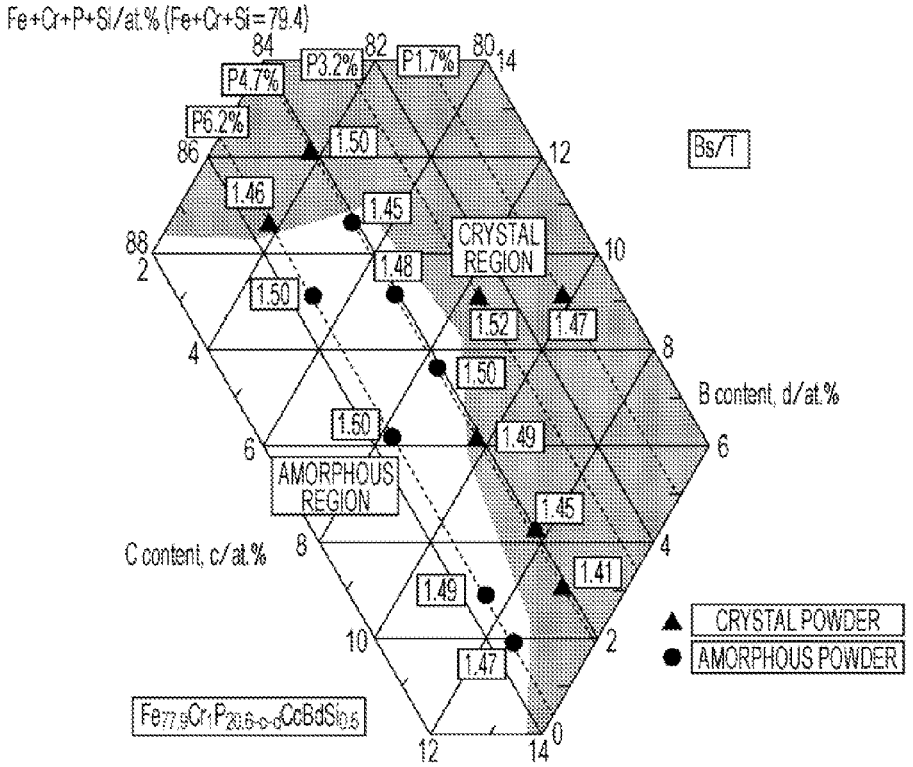
FIG. 12 is a graph showing the dependency of the saturation magnetic flux density Bs on the composition for $Fe_{77.9}Cr_1P_{(20.8-c-d)}C_cB_dSi_{0.5}$ produced by a water atomization method.

It was found from FIG. 12 and Table 2 that even an Fe-based amorphous alloy produced by a water atomization method has a compositional range where the alloy is amorphous and exhibits a saturation magnetic flux density Bs of about 1.5 T or higher.

However, as shown in FIG. 12, the Fe-based amorphous alloys produced by the water atomization method exhibited a saturation magnetic flux density Bs lower than that of the Fe-based amorphous alloys produced by the melt spinning method shown in FIG. 3 by about 0.05 T to 0.15 T.

In all Examples shown in Table 2, a glass transition temperature (Tg) emerged.

Limitations on Contents and Compositional Ratios in Examples (the Cr Content a is Excluded)

The experimental results described above show that it is difficult to form an amorphous structure when the P content b is excessively small and the saturation magnetic flux density Bs decreases when the P content b is excessively large.

Based on the experimental results, the P content b in Examples was set to 1.7 at % or more and 8.0 at % or less.

TABLE 2

| | Composition | | | | | | P + C + | P/(P + | C/ | | Particle |
|---|---|---|---|---|---|---|---|---|---|---|---|
| No. | Fe | Cr | P | C | B | Si | B + Si | C + B) | (C + B) | Powder structure | Bs/T |
| 84 | 77.9 | 1 | 1.7 | 9.7 | 9.2 | 0.5 | 21.1 | 0.08 | 0.51 | Cryst. + amorp. | 1.47 |
| 85 | 77.9 | 1 | 3.2 | 8.2 | 9.2 | 0.5 | 21.1 | 0.15 | 0.47 | Cryst. + amorp. | 1.52 |
| 86 | 77.9 | 1 | 4.7 | 3.7 | 12.2 | 0.5 | 21.1 | 0.23 | 0.23 | Cryst. + amorp. | 1.50 |
| 87 | 77.9 | 1 | 4.7 | 9.7 | 6.2 | 0.5 | 21.1 | 0.23 | 0.60 | Cryst. + amorp. | 1.49 |
| 88 | 77.9 | 1 | 4.7 | 11.2 | 4.7 | 0.5 | 21.1 | 0.23 | 0.70 | Cryst. + amorp. | 1.45 |
| 89 | 77.9 | 1 | 4.7 | 12.7 | 3.2 | 0.5 | 21.1 | 0.23 | 0.80 | Cryst. + amorp. | 1.41 |
| 90 | 77.9 | 1 | 6.2 | 3.7 | 10.7 | 0.5 | 21.1 | 0.30 | 0.26 | Cryst. + amorp. | 1.46 |
| 91 | 77.9 | 1 | 4.7 | 5.2 | 10.7 | 0.5 | 21.1 | 0.23 | 0.32 | Amorphous | 1.45 |
| 92 | 77.9 | 1 | 4.7 | 6.7 | 9.2 | 0.5 | 21.1 | 0.23 | 0.42 | Amorphous | 1.48 |
| 93 | 77.9 | 1 | 4.7 | 8.2 | 7.7 | 0.5 | 21.1 | 0.23 | 0.51 | Amorphous | 1.50 |
| 94 | 77.9 | 1 | 6.2 | 5.2 | 9.2 | 0.5 | 21.1 | 0.30 | 0.36 | Amorphous | 1.50 |
| 95 | 77.9 | 1 | 6.2 | 8.2 | 6.2 | 0.5 | 21.1 | 0.30 | 0.57 | Amorphous | 1.50 |
| 96 | 77.9 | 1 | 6.2 | 11.2 | 3.2 | 0.5 | 21.1 | 0.30 | 0.78 | Amorphous | 1.49 |
| 97 | 77.9 | 1 | 6.2 | 12.5 | 1.9 | 0.5 | 21.1 | 0.30 | 0.87 | Amorphous | 1.47 |

Of the samples shown in Table 2, Nos. 84 to 90 were confirmed to be a mixture of crystalline and amorphous phases and Nos. 91 to 97 were confirmed to be amorphous with an XRD (X-ray diffraction analyzer).

The saturation magnetic flux density Bs shown in Table 2 was measured with a VSM (vibrating sample magnetometer) under an application of 10 kOe magnetic field.

Three samples were chosen from Examples (those having amorphous powder structure) in Table 2 and indicated in Table 3 below. The curie temperature (Tc), the glass transition temperature (Tg), the crystallization onset temperature (Tx), and the melting temperature (Tm) of these samples were measured with DSC (differential scanning calorimeter) (heating rate was 0.67 K/sec for Tc, Tg, and Tx and 0.33 K/sec for Tm).

Since a water atomization method may be used to make an Fe-based amorphous alloy, the P content b is more preferably 4.7 at % or more and 6.2 at % or less in view of the experimental results shown in Table 3.

The Fe-based amorphous alloys shown in Tables 1 and 2 had a Si content e of 0 at % or 0.5 at %. It was found that even when the Si content e was 0 at %, a high Bs was achieved, a glass transition temperature (Tg) emerged, and formation of an amorphous structure was possible. In Examples, the range of the Si content e was set to 0 at % or more and 1.0 at % or less based on the assumption that the properties would not be much affected even when the maximum Si content e was set to a value slightly larger than that of the experiments because the content of at least one semimetal element selected from P, C, and B was lowered. A preferable range of the Si content e was set to 0 at % or more and 0.5 at % or less.

TABLE 3

| Composition | Structure | Tc/K | Tg/K | Tx/K | ΔTx/K | Tm*/K | Tg/Tm | Tx/Tm |
|---|---|---|---|---|---|---|---|---|
| $Fe_{77.9}Cr_1P_{6.2}C_{5.2}B_{9.2}Si_{0.5}$ | Amorphous | 613 | 722 | 460 | 42 | 1333 | 0.5400 | 0.57 |
| $Fe_{77.9}Cr_1P_{6.2}C_{8.2}B_{6.2}Si_{0.5}$ | Amorphous | 603 | 715 | 751 | 36 | 1337 | 0.5300 | 0.56 |
| $Fe_{77.9}Cr_1P_{6.2}C_{11.2}B_{3.2}Si_{0.5}$ | Amorphous | 572 | 710 | 742 | 32 | 1337 | 0.53 | 0.55 |

FIG. 12 shows the dependency of the saturation magnetic flux density Bs on the composition for $Fe_{77.9}Cr_1P_{(20.8-c-d)}C_cB_dSi_{0.5}$ in Table 2.

The Fe content (100-a-b-c-d-e) is preferably high in order to obtain a high saturation magnetic flux density Bs. In Examples, Bs was set to 77 at % or more. However, excessively increasing the Fe content decreases the Cr, P, C, B, and Si contents and may adversely affect the ability to form an amorphous structure, emergence of a glass transition temperature (Tg), and corrosion resistance. Thus, the maximum Fe content was set to 81 at % or less and preferably 80 at % or less.

The total content, (b+c+d+e), of P, C, B, and Si in Examples shown in Tables 1 and 2 was 19.0 at % or more and 21.1 at % or less.

The compositional ratio of P with respect to the total content of P, C, and B, [b/(b+c+d)], in Tables 1 and 2 was 0.08 or more and 0.43 or less.

The compositional ratio of C with respect to the total content of C and B, [b/(b+c)], in Tables 1 and 2 was 0.06 or more and 0.87 or less.

Preferable Compositional Range for Fe-Based Amorphous Alloys Produced by Melt Spinning Method Based on Table 1, a preferable range of the C content c in Examples was set to 0.75 at %≤c≤13.7 at %. A preferable range of the B content d was set to 3.2 at %≤d≤12.2 at %.

As shown in FIG. 3 and Table 1, a compositional region on the graph where no glass transition temperature (Tg) emerges starts to increase at a B content d of about 10 at % or more. A preferable range of the B content d was thus set to 10.7 at % or less to cause a glass transition temperature (Tg) to stably emerge without excessively narrowing the parameter ranges other than the B content.

As shown in Table 1, the glass transition temperature (Tg) tends to vanish when the compositional ratio of P with respect to the total content of P, C, and B, [b/(b+c+d)], is low, in other words, as the compositional ratio of p is decreased. Thus, the preferable range of [b/(b+c+d)] was set to 0.16 or more.

As shown in Table 1 and FIG. 3, it was found that a saturation magnetic flux density Bs of about 1.5 T or higher can be more reliably obtained by setting the compositional ratio of C with respect to the total content of C and B, [c/(c+d)], to 0.06 or more and 0.81 or less.

As shown in Table 1 and FIG. 6, a region in which the glass transition temperature (Tg) vanishes is easily reached as the compositional ratio C with respect to the total content of C and B, [c/(c+d)], increases. For example, suppose the C content and the B content in the graph of FIG. 6 are each at 8 at %, the region where the glass transition temperature (Tg) vanishes is reached faster when the C content c is increased therefrom than when the C content c is decreased therefrom while fixing the B content. It was also found that the glass transition temperature (Tg) shows an increasing tendency as the compositional ratio of C with respect to the total content of C and B, [c/(c+d)], is increased. Accordingly, the preferable range of [c/(c+d)] was set to 0.78 or less.

It was also found that a saturation magnetic flux density Bs of 1.6 T or more can be obtained by adjusting the compositional ratio of P in P, C, and B, [b/(b+c+d)], to 0.08 or more and 0.32 or less and adjusting the compositional ratio of C in C and B, [c/(c+d)], to 0.06 or more and 0.73 or less. More preferably, c/(c+d) is 0.19 or more.

Preferable Compositional Range for Fe-Based Amorphous Alloys Produced by Water Atomization Method As shown in Table 2 and FIG. 12, it was found that an amorphous alloy having a saturation magnetic flux density Bs of about 1.5 T can be obtained by adjusting the P content b to be in the range of 4.7 at % or more and 6.2 at % or less.

It was found that a saturation magnetic flux density Bs of about 1.5 T or higher can be stably obtained while achieving amorphicity by adjusting the C content c to 5.2 at % or more and 8.2 at % or less and a B content d to 6.2 at % or more and 10.7 at % or less. It was also found that the saturation magnetic flux density Bs can be more effectively stably increased by adjusting the B content d to 9.2 at % or less.

It was found that a saturation magnetic flux density Bs of about 1.5 T or higher can be obtained while achieving amorphicity by setting the compositional ratio of P with respect to the total content of P, C, and B, [b/(b+c+d)], to 0.23 or more and 0.30 or less and setting the compositional ratio of C with respect to the total content of C and B, [c/(c+d)], to 0.32 or more and 0.87 or less.

Based on the experimental results shown in Table 2 and FIG. 12, more preferably, 4.7 at %≤b≤6.2 at %, 5.2 at %≤c≤8.2 at %, 6.2 at %≤d≤9.2 at %, 0.23≤b/(b+c+d)≤0.30, and 0.36≤c/(c+d)≤0.57 for Fe-based amorphous alloys produced by a water atomization method. In this manner, a saturation magnetic flux density Bs of 1.5 T or higher can be stably obtained.

Cr Content a

In the compositions shown in Tables 1 and 2, the Cr content is fixed at 1 at %. In the next experiment, the saturation magnetic flux density Bs and the same properties as those in Table 1 were measured by varying the Cr content a so as to specify the Cr content a.

In the experiment, Fe-based amorphous alloy ribbons having a composition of $Fe_{78.9-a}Cr_aP_{3.2}C_{8.2}B_{9.2}Si_{0.5}$ were obtained under the same production conditions as the samples shown in Table 1.

In the experiment, the Cr content a was varied from 0 at % to 6 at % and the same properties as those shown in Table 1 were measured. The experimental results are shown in Table 4 below.

TABLE 4

$Fe_{78.9-a}Cr_aP_{3.2}C_{8.2}B_{9.2}Si_{0.5}$

| x/at % | Structure | Tc/K | Tg/K | Tx/K | ΔTx/K | Tm* | Tg/Tm | Tx/Tm | σs ($\times10^{-6}$ · Wbm/kg) | D (g/cm$^3$) | Bs T |
|---|---|---|---|---|---|---|---|---|---|---|---|
| 0 | Amorphous | 645 | 738 | 765 | 27 | 1423 | 0.519 | 0.538 | 223 | 7.49 | 1.67 |
| 0.5 | Amorphous | 633 | 738 | 766 | 28 | 1425 | 0.518 | 0.538 | 216 | 7.49 | 1.62 |
| 1 | Amorphous | 624 | 738 | 767 | 29 | 1428 | 0.517 | 0.537 | 210 | 7.50 | 1.57 |
| 1.5 | Amorphous | 613 | 739 | 768 | 29 | 1430 | 0.517 | 0.537 | 203 | 7.50 | 1.52 |
| 1.9 | Amorphous | 605 | 739 | 769 | 30 | 1431 | 0.516 | 0.537 | 200 | 7.50 | 1.50 |
| 2 | Amorphous | 600 | 739 | 769 | 30 | 1433 | 0.516 | 0.537 | 197 | 7.50 | 1.48 |
| 2.5 | Amorphous | 590 | 739 | 771 | 32 | 1434 | 0.515 | 0.538 | 192 | 7.50 | 1.44 |
| 3 | Amorphous | 580 | 739 | 772 | 33 | 1436 | 0.515 | 0.538 | 188 | 7.50 | 1.41 |
| 4 | Amorphous | 558 | 740 | 774 | 34 | 1439 | 0.514 | 0.538 | 178 | 7.50 | 1.34 |

TABLE 4-continued

| $Fe_{78.9-a}Cr_aP_{3.2}C_{8.2}B_{9.2}Si_{0.5}$ | | | | | | | | | | | |
|---|---|---|---|---|---|---|---|---|---|---|---|
| x/at % | Structure | Tc/K | Tg/K | Tx/K | ΔTx/K | Tm* | Tg/Tm | Tx/Tm | σs ($\times 10^{-6}$ · Wbm/kg) | D ($g/cm^3$) | Bs T |
| 5 | Amorphous | 533 | 740 | 776 | 36 | 1443 | 0.513 | 0.538 | 170 | 7.50 | 1.27 |
| 6 | Amorphous | 515 | 740 | 779 | 39 | 1447 | 0.511 | 0.538 | 161 | 7.50 | 1.20 |

Figure 13:
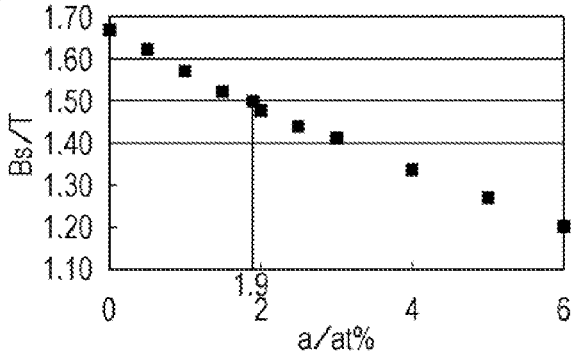
FIG. 13 is a graph showing the relationship between the Cr content a and the saturation magnetic flux density Bs.

FIG. 13 is a graph showing the relationship between the saturation magnetic flux density Bs and the Cr content a shown in Table 4.

As shown in Table 4 and FIG. 13, it was found that the saturation magnetic flux density Bs gradually decreases with the increase in Cr content a.

Based on this experiment, the Cr content a was set to be within the range of 0 at %≤a≤1.9 at %. A preferable Cr content a for obtaining good corrosion resistance was set to 0.5≤a≤1.9 at % although the saturation magnetic flux density Bs is slightly decreased in this range.

Magnetic Properties of Dust Core (Toroidal Core)

In the experiment, dust cores of Examples were prepared by using Fe-based amorphous alloy powder of No. 94 ($Fe_{77.9}Cr1P_{6.3}C_{5.2}B_{9.2}Si_{0.5}$; Bs=1.5 T) shown in Table 2.

Dust cores of Comparative Examples were prepared by using Fe-based amorphous alloy powder (Bs=1.2 T) having a composition of $Fe_{77.4}Cr_2P_9C_{2.2}B_{7.5}Si_{4.9}$ or Fe-based amorphous alloy powder (Bs=1.35 T) having a composition of $Fe_{77.9}Cr_1P_{7.3}C_{2.2}B_{7.7}Si_{3.9}$.

In Examples and Comparative Examples, 1.4 wt % of a silicone resin and 0.3 wt % of a lubricant (fatty acid) were added to magnetic powder and mixed. The resulting mixture was dried for two days and pulverized. Then a toroidal core having an outer diameter of 20 mm, an inner diameter of 12 mm, and a thickness of 7 mm was prepared by press-forming (at a pressure of 20 ton/$cm^2$).

The toroidal core obtained as such was heat-treated at 400° C. to 500° C. in a $N_2$ atmosphere for 1 hour.

As shown in Table 5 below, the heat treatment temperature was adjusted so that the initial permeability ($\mu_0$) was substantially the same between Example 1 and Comparative Example 1, between Example 2 and Comparative Example 2, and between Example 3 and Comparative Example 3.

In the experiment, a wire was wound around each of the toroidal cores of Examples and Comparative Examples and the change in permeability μ was measured by applying a bias magnetic field to each core up to a maximum of 4130 A/m (DC superimposition characteristics).

Figure 17:
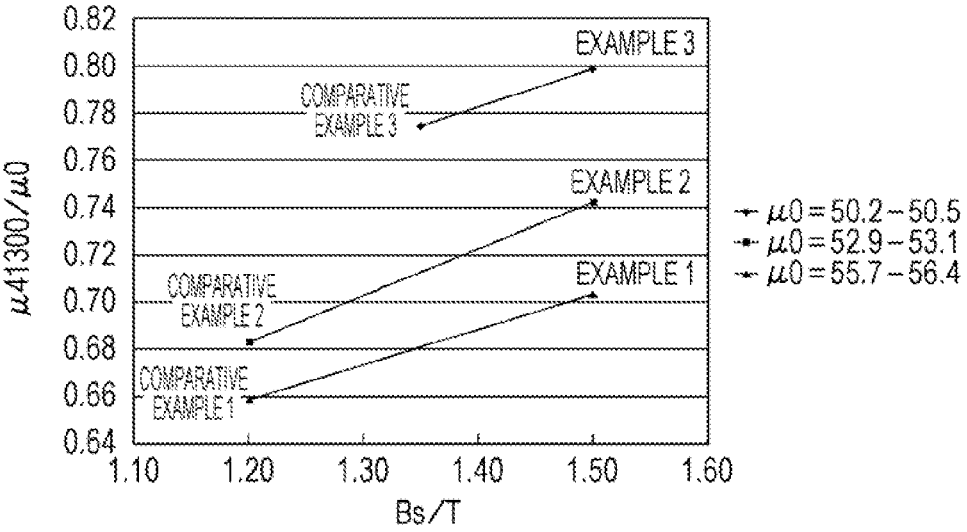
FIG. 17 is a graph showing the relationship between the saturation magnetic flux density Bs and $\mu_{41300}/\mu_0$ of each of the dust cores of Examples 1 to 3 and Comparative Examples 1 to 3 shown in FIGS. 14 to 16.

Table 5 below shows the saturation magnetic flux density Bs, the initial permeability $\mu_0$, the permeability $\mu_{4130}$ under 4130 A/m bias, and $\mu_{4130}/\mu_0$ of each sample. The figures for $\mu_{4130}/\mu_0$ in Table 5 were rounded off to two decimal places. FIG. 17 referred to below uses data that had not been rounded off to two decimal places.

TABLE 5

| | Powder composition | Powder Bs/T | μ0 | μ4130 | μ4130/μ0 |
|---|---|---|---|---|---|
| Comparative Example 1 | $Fe_{77.4}Cr_2P_9C_{2.2}B_{7.5}Si_{4.9}$ | 1.20 | 56.4 | 37.1 | 0.66 |
| Example 1 | $Fe_{77.9}Cr_1P_{6.2}C_{5.2}B_{9.2}Si_{0.5}$ | 1.50 | 55.7 | 39.2 | 0.70 |
| Comparative Example 2 | $Fe_{77.4}Cr_2P_9C_{2.2}B_{7.5}Si_{4.9}$ | 1.20 | 53.1 | 36.3 | 0.68 |
| Example 2 | $Fe_{77.9}Cr_1P_{6.2}C_{5.2}B_{9.2}Si_{0.5}$ | 1.50 | 52.9 | 39.3 | 0.74 |

TABLE 5-continued

| | Powder composition | Powder Bs/T | μ0 | μ4130 | μ4130/μ0 |
|---|---|---|---|---|---|
| Comparative Example 3 | $Fe_{77.9}Cr_1P_{7.3}C_{2.2}B_{7.7}Si_{3.9}$ | 1.35 | 50.5 | 39.1 | 0.77 |
| Example 3 | $Fe_{77.9}Cr_1P_{6.2}C_{5.2}B_{9.2}Si_{0.5}$ | 1.50 | 50.2 | 40.1 | 0.80 |

As shown in Table 5, Example 1, Example 2, and Example 3 had the same powder composition and the same saturation magnetic flux density Bs; however, the heat-treatment temperature was changed so that the initial permeability $\mu_0$ was adjusted to be substantially the same as that of the corresponding comparative example.

The saturation magnetic flux density Bs in Comparative Example was lower than in Examples and was outside the compositional range of Examples.

Table 6 below shows the permeability μ of each sample relative the magnitude of the bias magnetic field.

TABLE 6

| DC superimposition characteristic curve (dependency of μ on bias magnetic field) | | | | | | |
|---|---|---|---|---|---|---|
| | μ | | | | | |
| H/A · $m^{-1}$ | Comparative Example 1 | Example 1 | Comparative Example 2 | Example 2 | Comparative Example 3 | Example 3 |
| 0 | 56.4 | 55.7 | 53.1 | 52.9 | 50.5 | 50.2 |
| 690 | 54.3 | 54.6 | 51.6 | 51.9 | 49.4 | 49.8 |
| 1380 | 51.6 | 52.6 | 49.6 | 50.4 | 47.9 | 48.8 |
| 2060 | 48.0 | 49.6 | 46.7 | 48.2 | 46.0 | 47.2 |
| 2750 | 44.1 | 46.0 | 43.2 | 45.2 | 43.7 | 45.0 |
| 3440 | 40.3 | 42.4 | 39.6 | 42.1 | 41.4 | 42.6 |
| 4130 | 37.1 | 39.2 | 36.3 | 39.3 | 39.1 | 40.1 |

Figure 14:
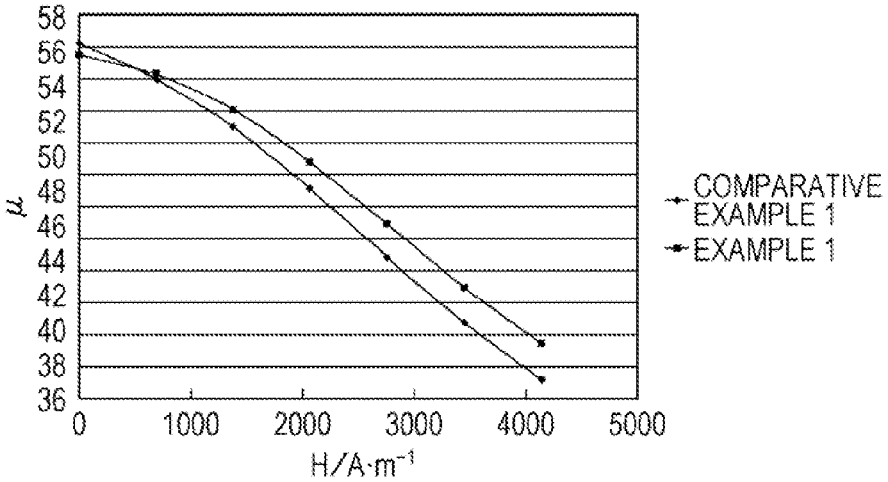
FIG. 14 is a graph showing the relationship between the bias magnetic field and the permeability for each dust core of Example 1 and Comparative Example 1.

The relationship between the bias magnetic field and the permeability μ of Example 1 and Comparative Example 1 is determined based on the experimental results of Table 6 and shown in FIG. 14. The relationship between the bias magnetic field and the permeability μ of Example 2 and Comparative Example 2 is determined based on the experimental results of Table 6 and shown in FIG. 15. The relationship between the bias magnetic field and the permeability μ of Example 3 and Comparative Example 3 is determined based on the experimental results of Table 6 and shown in FIG. 16.

The lower the rate of decrease in permeability μ under application of a bias magnetic field, the better the DC superimposition characteristics.

Figure 15:
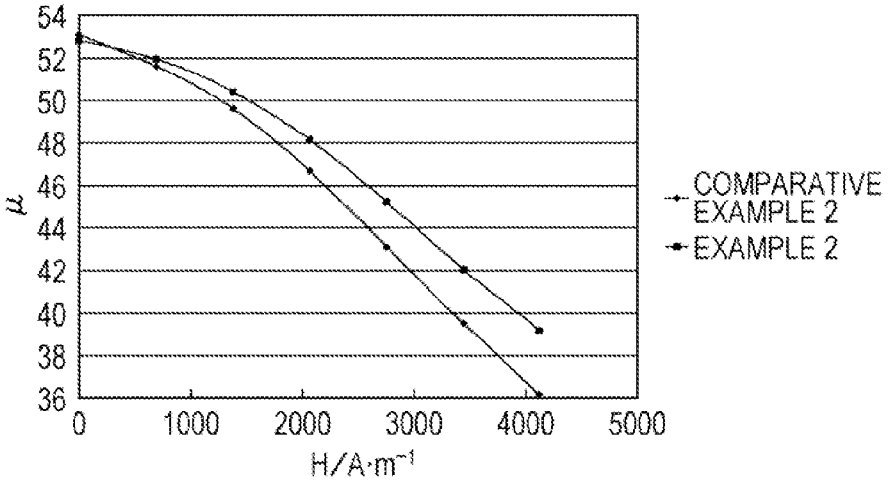
FIG. 15 is a graph showing the relationship between the bias magnetic field and the permeability for each dust core of Example 2 and Comparative Example 2.
Figure 16:
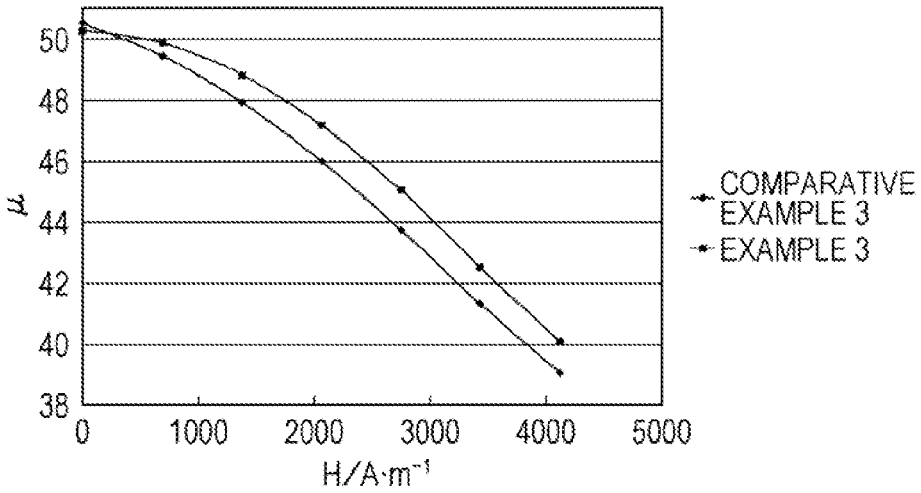
FIG. 16 is a graph showing the relationship between the bias magnetic field and the permeability for each dust core of Example 3 and Comparative Example 3.

Accordingly, it was found from the experimental results shown in FIGS. 14 to 16 that the rate of decrease in permeability μ is smaller in Examples than in Comparative Examples and better DC superimposition characteristics can be obtained in Examples.

The dependency of $\mu_{4130}/\mu_0$ on Bs was also investigated on the basis of the experimental results shown in Table 5. The results are shown in FIG. 17.

As shown in FIG. 17, it was found that the larger the saturation magnetic flux density Bs, the larger the $\mu_{4130}/\mu_0$, confirming the effects of increasing the Bs of magnetic powder.

What is claimed is:

1. An Fe-based amorphous alloy consisting of Fe, Cr, P, C, B, and Si, represented by a formula $Fe_{100-a-b-c-d-e}Cr_aP_bC_cB_dSi_e$, where a, b, c, d, and e are in terms of at %, wherein a composition ratio a of Cr satisfies 0 at %≤a≤1.9 at %, a composition ratio b of P satisfies 4.7 at %≤b≤6.2 at %, a composition ratio c of C satisfies 5.2 at %≤c≤8.2 at %, a composition ratio d of B satisfies 6.2 at %≤d≤10.7 at %, a composition ratio e of Si satisfies 0 at %≤e≤1.0 at %, a composition ratio of Fe (100-a-b-c-d-e) is 77 at % or more, and the composition ratios b, c, d, and e satisfy the following relationships:

$$19 \text{ at } \% \le b+c+d+e \le 21.1 \text{ at } \%,$$

$$0.08 \le b/(b+c+d) \le 0.43,$$

$$0.06 \le c/(c+d) \le 0.87, \text{ and}$$

wherein the Fe-based amorphous alloy exhibits a glass transition point (Tg) and have a saturation magnetic flux density equal to or higher than 1.5 T.

2. The Fe-based amorphous alloy according to claim 1, wherein the ratio b/(b+c+d) satisfies 0.16≤b/(b+c+d)≤0.43.

3. The Fe-based amorphous alloy according to claim 1, wherein the ratio c/(c+d) satisfies 0.06≤c/(c+d)≤0.81.

4. The Fe-based amorphous alloy according to claim 1, wherein the composition ratio e satisfies 0 at %≤e≤0.5 at %.

5. The Fe-based amorphous alloy according to claim 1, wherein the composition ratios b, c, and d satisfy 0.08≤b/(b+c+d)≤0.32 and 0.06≤c/(c+d)≤0.73.

6. The Fe-based amorphous alloy according to claim 1, wherein the composition ratio d satisfies 6.2 at %≤d≤9.2 at %.

7. The Fe-based amorphous alloy according to claim 1, wherein the composition ratios b, c, and d satisfy 0.23≤b/(b+c+d)≤0.30 and 0.32≤c/(c+d)≤0.87.

8. The Fe-based amorphous alloy according to claim 1, wherein the composition ratios b, c, and d satisfy 6.2 at %≤d≤9.2 at %, 0.23≤b/(b+c+d)≤0.30, and 0.36≤c/(c+d)≤0.57.

9. The Fe-based amorphous alloy according to claim 1, produced by a water atomization method.

10. The Fe-based amorphous alloy according to claim 1, wherein the saturation magnetic flux density is 1.6 T or higher.

11. A dust core comprising a powder of the Fe-based amorphous alloy according to claim 1 and a binder.

12. An Fe-based amorphous alloy consisting of Fe, Cr, P, C, and B, represented by a formula $Fe_{100-a-b-c-d}Cr_aP_bC_cB_d$, where a, b, c, and d are in terms of at %, wherein a composition ratio a of Cr satisfies 0 at %≤a≤1.9 at %, a composition ratio b of P satisfies 4.7 at %≤b≤6.2 at %, a composition ratio c of C satisfies 5.2 at %≤c≤8.2 at %, a composition ratio d of B satisfies 6.2 at %≤d≤10.7 at %, a composition ratio of Fe (100-a-b-c-d) is 77 at % or more, and the composition ratios b, c, and d satisfy the following relationships:

$$19 \text{ at } \% \le b+c+d \le 21.1 \text{ at } \%,$$

$$0.08 \le b/(b+c+d) \le 0.43,$$

$$0.06 \le c/(c+d) \le 0.87, \text{ and}$$

wherein the Fe-based amorphous alloy has a glass transition point (Tg).

* * * * *